US007232404B2

(12) United States Patent
Nelson

(10) Patent No.: US 7,232,404 B2
(45) Date of Patent: Jun. 19, 2007

(54) ABDOMINAL EXERCISE MACHINE

(75) Inventor: Robert W. Nelson, Rowlett, TX (US)

(73) Assignee: Tristar Products, Inc., Reading, PA (US)

( * ) Notice: Subject to any disclaimer, the term of this patent is extended or adjusted under 35 U.S.C. 154(b) by 110 days.

(21) Appl. No.: 11/030,420

(22) Filed: Jan. 5, 2005

(65) Prior Publication Data

US 2006/0166798 A1 Jul. 27, 2006

Related U.S. Application Data

(60) Provisional application No. 60/541,744, filed on Jan. 5, 2004.

(51) Int. Cl.
*A63B 26/00* (2006.01)
*A63B 71/00* (2006.01)

(52) U.S. Cl. ..... 482/140; 482/70; 482/132

(58) Field of Classification Search ..... 482/140, 482/907, 91, 70, 132; D21/662, 674
See application file for complete search history.

(56) References Cited

U.S. PATENT DOCUMENTS 5,620,403 A * 4/1997 Lundin ..... 482/96
6,634,996 B2 * 10/2003 Jacobsen ..... 482/96
2004/0248713 A1 * 12/2004 Campanaro et al. ..... 482/123
2005/0085348 A1 * 4/2005 Kiefer et al. ..... 482/72

OTHER PUBLICATIONS

AB Lounge, website descripition from "www.fitnessquest.com", printout on Jan. 5, 2005.
AB Scissor, website descripition from "www.bodybyjake.com", printout on Jan. 5, 2005.
AB DOLLY2, website descripition from "www.fitnessquest.com", printout on Jan. 5, 2005.
AB SLIDE[R], website review of the AB SLIDE[R] from "www.fitness-equipment-review.com" printout on Jan. 5, 2005.
AB SLIDER, website descripition from "wonderfulbuys.com", printout on Jan. 5, 2005.

* cited by examiner

*Primary Examiner*—Lori Amerson
(74) *Attorney, Agent, or Firm*—Cislo & Thomas LLP

(57) ABSTRACT

The abdominal exerciser of the present invention is an exercise device designed to work the abdominal and oblique muscle groups. The abdominal exerciser includes a sled that is supported by and slides or rolls along at least one track. The upper body support is ergonomically positioned higher than the sled, and fixed to a cross bar supported by the track. The cross bar is designed to rotate forward to simulate an abdominal exercise "crunch" motion when the knees are brought within proximity of the upper body support.

17 Claims, 4 Drawing Sheets

ABDOMINAL EXERCISE MACHINE

CLAIM TO PRIORITY

The present application claims the benefit of to U.S. Provisional Patent Application entitled "Ab Razor," Application No. 60/541,744, filed on Jan. 5, 2004 which is incorporated herein by reference.

BACKGROUND OF THE INVENTION

1. Technical Field

The present invention relates to exercise machines and methods and more particularly, the invention relates to an exercise machine and method that targets the abdominal muscles.

2. Description of Related Art

There are numerous abdominal exercises that an individual may practice in order to decrease abdominal girth, strengthen the abdominal muscles and maintain abdominal muscle tone.

The various abdominal exercises generally known as crunch exercises have long been regarded as among the most effective for strengthening and toning the abdominal muscles. However, performing these exercises requires repeated stress and strain the muscles of the head, neck, and back which can cause inefficiency, discomfort, and even injury.

For example, a very common exercise of the abdominal muscles is a sit-up wherein a person lies on the floor or an inclined bench with legs secured and repeatedly bends at the waist to cause the upper torso to move forward and then away from the legs. This type of exercise is known to cause overload to the spine and neck and can easily cause injury when sitting up from a prone position to a sitting position. To correct this problem, many devices and exercises have been created in an attempt to develop and maintain the abdominal muscles. Unfortunately these devices and exercises often produce results which do not necessarily strengthen the abdominal muscles but strengthen the hip and thigh muscles attached to the lumbar spine area and to the rear of the pelvis and hip bones. When such muscles contract not only does the rectus muscle of the abdomen work with little effort but the other muscles rotate the pelvis forward thus creating the occurrence of increased lower back pain which contributes to poor mechanical alignment and undesirable upright posture of the exerciser.

For example, abdominal exercises that use arm slings and the person hanging from a bar are only beneficial to advanced athletes that are able to perform the exercise effectively. However, even when performed effectively, the back is extremely overloaded and the hip-flexors handle much of the load creating a risk of injury.

Also, lower abdominal exercises utilizing leg raises or reverse cruches where the knees are raised to the chest while the body is suspended vertically, supported only by arms or elbows, are strenuous on the lower back and offer minimal back support. These types of exercises are especially bad due to excessive strain on the back caused by lifting the knees to the chest. Furthermore, a significant number of people who do this type of abdominal exercise become injured with continued use.

Also, some exercise machines concentrate on cardio training with too little resistance thereby producing semi-effective strength training with very limited results. For example, exercise machines similar to the AB LOUNGE or AB SCISSOR provide more isolation than the above abdominal exercise but do not provide enough resistance because the exercise motions performed with these devices do not provide a resistance that is consistent with strength training.

In addition, exercise machines similar to the AB DOLLEY or AB SLIDE are effective for upper abdominal muscles and upper torso but not for lower abdominals. Also, exercises using these types of devices are difficult and dangerous for two reasons: first resistance is concentrated downward by gravity making isolation on the abdominal muscles impossible, as the entire upper torso, front and back muscles, and arms are needed to handle the load; and second, the user's back is forced into an ergonomically unfriendly angle with the upper body which is operating too low in conjunction with the lower body. Such a position is uncomfortable, awkward and can cause injury.

What is needed is an abdominal exerciser that will isolate the upper and lower abdominal muscles with true strength conditioning to change the shape of the overall abdomen muscle structure without compromising safety or support for the back. It would be beneficial if the apparatus could enable a user to execute the abdominal exercise in a biometrically neutral position, minimizing or eliminating back and neck strain. It would also be beneficial if the user could perform an upper abdominal crunch simultaneously with a controlled and supported reverse crunch. It would further be beneficial if the apparatus could allow the user to hold either the upper or lower crunch in a fully contracted 'isometric' position while continuing with the opposite crunch rendering a dynamically concentrated isolation of the abdominal muscles.

SUMMARY OF THE INVENTION

The abdominal exerciser of the present invention is an exercise device designed to work the abdominal and oblique muscle groups. The abdominal exerciser includes a sled that is supported by and slides or rolls along at least one track. The upper body support is ergonomically positioned higher than the sled, and fixed to a cross bar supported by the track. The cross bar is designed to rotate forward to simulate a "crunch" motion when the knees are brought within proximity of the upper body support.

The track that supports the sled is fixed to front and rear foundations at opposite ends of the track. The front foundation includes a telescopic extension to raise the height of one end of the track to a desired level of inclination.

To perform the abdominal exercise, a user first positions the forearms on the upper body support and then positions the shins onto the sled. The user then slides the sled towards the upper body support by using the abdominal muscles to bring the knees as close as possible to the upper body support.

Near the point of maximum forward motion of the sled, the user has the option to rock the upper body support forward simulating a sit up or what is known as a "crunch" motion.

An optional pad is attached to the upper body support to rest the chest, head, or chin in order to increase the user's pressure with the forward crunch motion. The optional pad can also changes the dynamics of the exercise and the muscles worked. A compression spring or other type of resistance can provide increased resistance for this motion.

Resistance to sliding the sled is provided by a user's body weight working against gravity, as it is forced upward on the inclined tracks. Resistance can be increased or decreased by raising and lowering the level of incline. Also, resistance bands or free weights attached to the sled may be used for additional resistance.

The abdominal exerciser of the present invention isolates the upper and lower abdominal muscles with true strength conditioning to change the shape of the overall abdomen muscle structure without compromising safety or support for the back. It also enables a user to execute the abdominal exercise in a biometrically neutral position, minimizing or eliminating back and neck strain. In addition, the abdominal exerciser of the present invention allows a user to perform an upper abdominal crunch simultaneously with a controlled and supported reverse crunch. Also, it allows a user to hold either the upper or lower crunch in a fully contracted isometric position while continuing with the opposite crunch rendering a dynamically concentrated isolation of the abdominal muscles.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
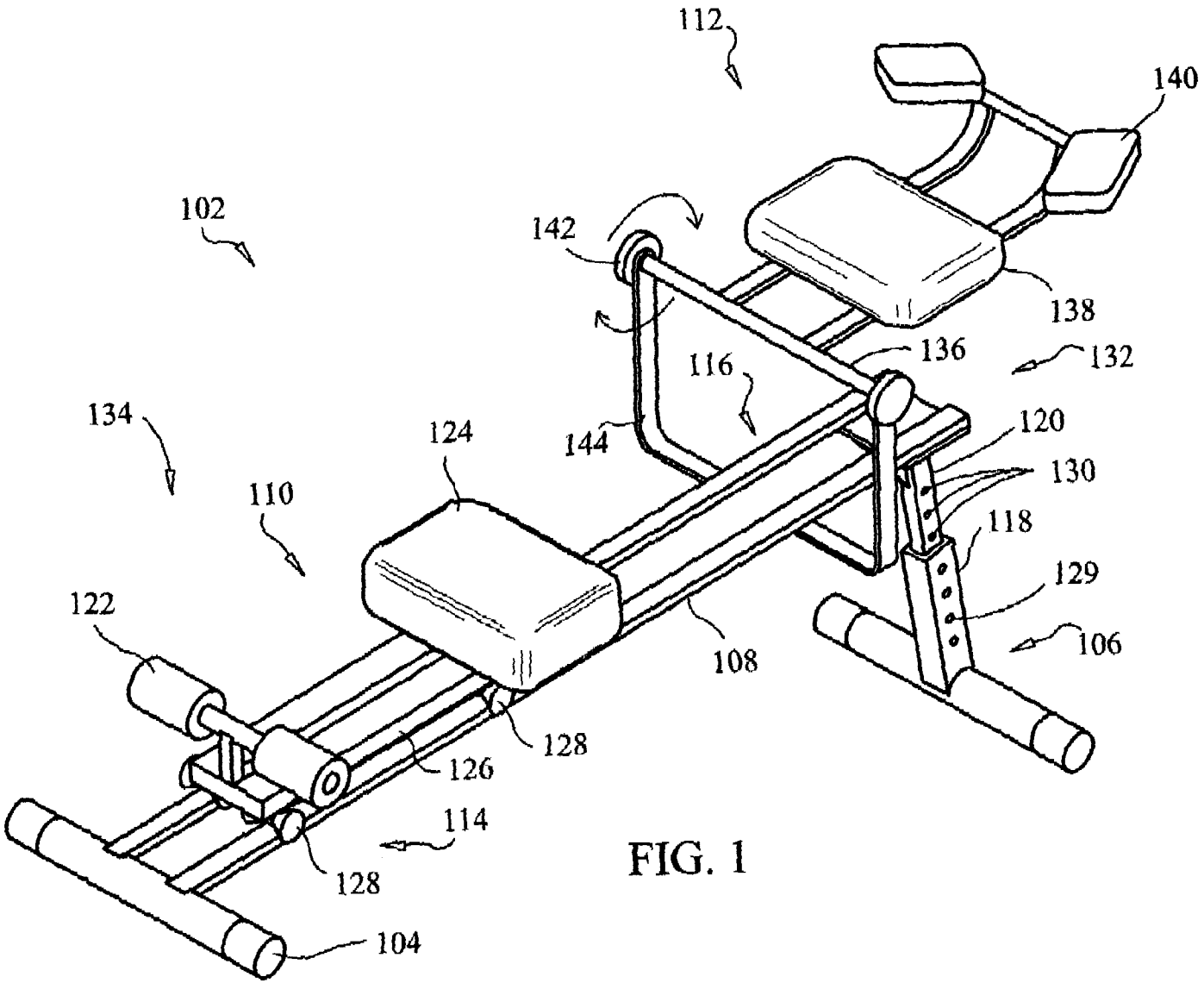
FIG. 1 is a perspective view of an abdominal exercise apparatus in accordance with the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

FIG. 1 shows one embodiment of abdominal exerciser 102. Abdominal exerciser 102 has a front portion 132, rear portion 134 and contains rear support 104, forward support 106, track 108, sled, 110, and upper body support 112.

Rear support 104 rests on the ground and provides foundational support for abdominal exerciser 102. Rear support 104 may have a long tubular profile, a solid square or rectangular profile, or any other profile known in the art for use as support of a bench like structure similar to abdominal exerciser 102. Rear support 104 is attached to track 108.

Track 108 is made of metal, plastic with a metal or TEFLON coating or some other material that has a relatively low coefficient of friction with the material used to make roller 128. In the preferred embodiment there are two tracks 108, however in other embodiments there may be only one track or, alternatively, more than two tracks. Track 108 extends from rear support 104 to forward support 106 and has a rear portion 114 proximate to rear support 104 and a forward portion 116 proximate to forward support 106.

Forward support 106 elevates forward portion 1156 of track 108 at least approximately 6 inches off the ground and contains hollow outer base 118 and adjustable top portion 120 and provides foundational support for abdominal exerciser 102. Base 118 may have a long tubular profile, a solid square or rectangular profile, or any other profile known in the art for use as support for a bench like structure similar to abdominal exerciser 102.

Adjustable top portion 120 is slidably mounted within outer base 118 in telescoping relation. By sliding the adjustable top portion 120 inwardly or outwardly relative to outer base 118, the overall length of forward support 106 can be selectively changed to vary the height of forward support 106. A locking means is provided for locking outer base 118 and adjustable top portion 120 in desired relative positions to create a desired length for forward support 106.

Preferably, the locking means includes at least one hole 129 in outer base 118 and a plurality of holes 130 in adjustable top portion 120 which can be selectively aligned with least one hole 129 in outer base 118. A pin member is constructed to be inserted in the aligned holes, thereby securely locking forward support 106 in the desired length. At least one hole 129 and holes 130 may be threaded holes, and the pin member may have cooperating threads to enable the pin to be threaded or screwed into the holes to secure forward support 106 at a desired length. Track 108 is secured to forward support 106 and forward support 106 elevates tracks 108 to a desired level, preferably at least approximately 6 inches above to provide an incline.

Sled 110 glides along track 108. Sled 110 contains sled base 126. Attached to sled base 126 are instep pad 122, knee pad 124, and roller 128. Roller 128 may be made of metal, plastic with a metal or Teflon® coating or some other material that has a relatively low coefficient of friction on the material used to make track 108. In and alternate embodiment, roller 128 may be ball bearings or some other means which would allow sled 110 to travel along track 108 with a relatively low coefficient of friction.

Instep pad 122 is made of dense foam, rubber, or some other similar material. The purpose of instep pad 122 is to elevate the feet to avoid interfering with the movement of the sled. Other means may be used to elevate the feet such as a wedge or the feet may not be elevated at all.

In one embodiment, knee pad 124 can pivot approximately 2 to 45 degrees to the right or left of a plane vertical to the center of sled 110. By pivoting knee pad 124 the oblique muscles can be effectively exercised.

Sled 110 can travel the entire length of track 108 but preferably travels to the approximate area of upper body support 112.

Upper body support 112 is attached to front portion 132 of abdominal exerciser 102 and comprises elevation bar 144, cross bar 136, arm pad 138, and chest pad 140. Elevation bar 144 is attached to track 108 such that sled 110 can travel past elevation bar 144. In an alternate embodiment, elevation bar 144 is attached to track 108 such that sled 110 cannot travel past elevation bar 144. In addition, elevation bar 144 may be attached to forward support 106. Cross bar 136 is pivotally attached to elevation bar 144 and suspend approximately 12 to 48 inches above track 108.

Cross bar 136 is pivotally attached to elevation bars such that the amount of torque required to rotate cross bar 136 can be adjusted, preferably by tension control member 142.

Tension control member 142 controls the amount of resistance required to rotate cross bar 136 and can be set such that cross bar 136 may be locked in any rotational position especially one where arm pad 138 has been rotated towards track 108.

Arm pad 138 is attached to cross bar 136, has a general rectangular or square profile, and is made of dense foam or some other similar material. Arm pad 138 provides support for the arms during use. Chest pad 140 is attached to arm pad 138 and elevated approximately 1 to 36 inches above arm pad 138. Chest pad 140 has a general cylindrical, rectangular, or square profile and is made of dense foam or some other similar material. Chest pad 140 provides support for the chest during use. In an alternate embodiment, a head support may be used to support the head. In addition, shoulder pads may be used in conjunction with or to replace chest pad 140. Other means to support the upper body of the user would be apparent to one skilled in the art.

Figure 2:
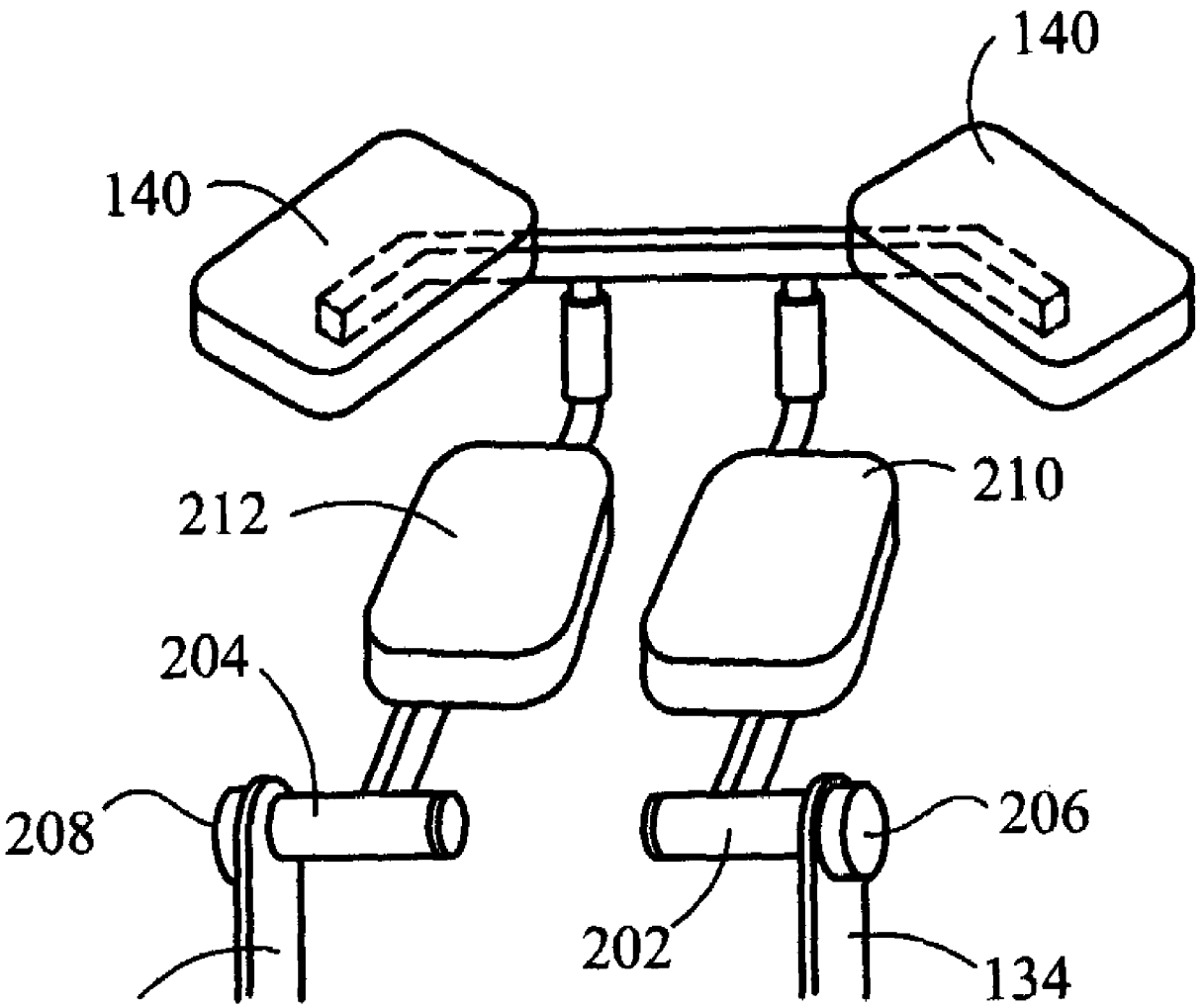
FIG. 2 is a front view of an alternate embodiment of an upper body support of an abdominal exercise apparatus in accordance with the present invention.

In an alternate embodiment, shown in FIG. 2, the cross bar 136 is divided into two sections, right bar section 202 and left bar section 204. Right bar section 202 and left bar section 204 are pivotally attached to elevation bar 144 such that the torque required to rotate right bar section 202 and left bar section 204 can be adjusted, preferably by a tension control members 206 and/or 208 respectively. Tension control members 206 and 208 controls the amount of resistance required to rotate right bar section 202 and left bar section 204 and can be set such that right bar section 202 and left bar section 204 may be locked in any rotational position especially one where arm pad 138 has been rotated towards the track 108. Tension control members 206 and 208 have markings or slots such that each one can be set to the same tension as the other or only one tension control member may be used to control the amount of resistance required to rotate the upper body support 112.

The chest pad 140 is also divided into two sections, right pad 210 and left pad 212. Right pad 210 and left pad 212 are attached to right bar section 202 and left bar section 204 respectively. In an alternate embodiment, chest pad 140 is a single one piece member.

Figure 3:
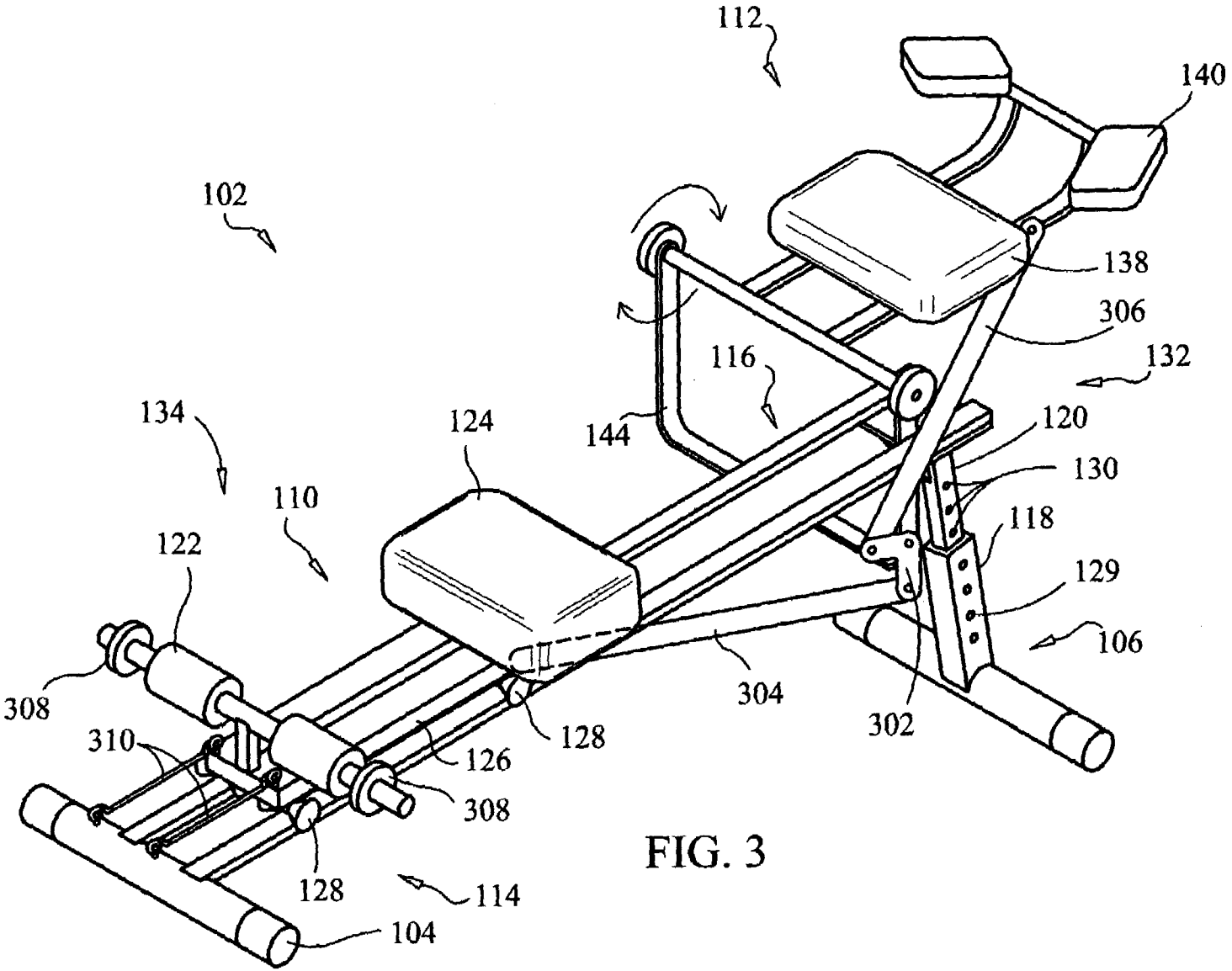
FIG. 3 is a perspective view of an alternate embodiment of an abdominal exercise apparatus in accordance with the present invention.

FIG. 3 shows an alternate embodiment wherein upper body support 112 is pivoted when sled 110 is accelerated towards upper body support 112. As shown in FIG. 3, the pivot means is a bell crank with pivot member 302 attached to elevation bar 144, lower arm 304 attached to sled 110, and upper arm 306 attached to upper body support 112. In use, when sled 110 is accelerated towards upper body support, lower arm 304 pushes pivot member 302 causing it to rotate and pull down on upper arm 306, which causes upper body support 112 to rotate. A second function of the pivot means is to help accelerate sled 110 towards upper body support 112 by rotating upper body support 112 towards track 108.

Use of a pivot means, such as the bell crank, forces the user to perform an upper abdominal crunch simultaneously with a controlled and supported reverse crunch. As would be known in the art, other means may be used to pivot upper body support 112 when sled 110 is accelerated towards upper body support 112. For example, other mechanical means similar to a bell crank or a cable and pulley system may be used to pivot upper body support 112 when sled 110 is accelerated towards upper body support 112.

To increase resistance, free weight 308 may be attached to sled 110. In addition, resistance bands 310 may also be used to increase resistance. Resistance bands are elastic and attached to rear support 104 and sled 110.

Figure 4:
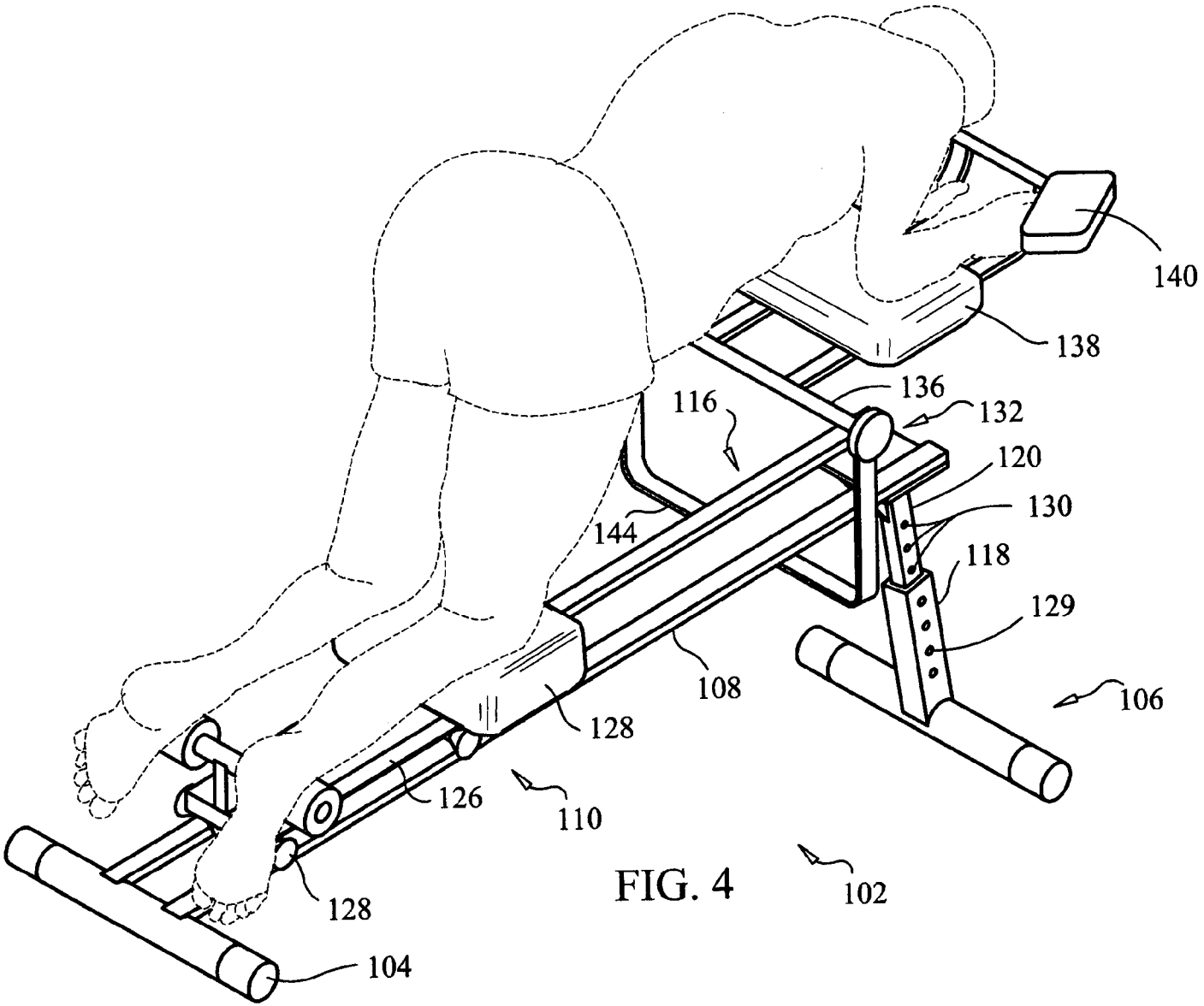
FIG. 4 is a perspective view of the apparatus shown in FIG. 1 in use by a person.

In use, as shown in FIG. 4, the forearms are positioned on upper body support 112 and the shins are positioned onto instep pads 122 on sled 110. Sled 110 is then accelerated towards upper body support 112 by bringing the knees as close as possible to upper body support 112 while keeping forearms positioned on upper body support 112.

By pivoting knee pad 124 approximately 5 to 45 degrees to the right or left of a plane vertical to the center of sled 110 the force needed to accelerate sled 110 can be supplied by the right or left oblique muscles. In addition, the knees may be brought as high as possible at the peak of the contracted point of both crunches, rendering a tight squeeze in a near fetal position.

To perform an upper body crunch the legs are frozen at a 90 degree angle with respect to knee pad 124 while sled 110 is accelerated towards upper body support 112 and cross bar 136 is pivoted towards track 108. Then, using the upper abdominal muscles, sled 110 is made to travel back and forth along track 108 while the legs and hips remaining locked at a 90 degree angle with respect to knee pad 124.

To perform a reverse crunch, the knees are allowed to freely move while sled 110 is accelerated towards upper body support 112 but cross bar 136 is not allowed to pivot in any direction. Then, using the lower abdominal muscles, sled 110 is made to travel back and forth along track 108 while cross bar 136 is locked in a desired position.

To perform a tandem crunch and exercise both the upper and lower abdominal muscles, the knees are allowed to freely move while sled 110 is accelerated towards upper body support 112 and cross bar 136 is pivoted towards track 108. Then, the upper and lower abdominal muscles are used to force sled 110 to travel back and forth along track 108 while cross bar 136 is pivoted towards track 108.

Although the invention has been described with reference to one or more preferred embodiments, the description is not to be construed in a limiting sense. There is modification of the disclosed embodiments, as well as alternative embodiments of this invention, which will be apparent to persons of ordinary skill in the art and various changes in form and detail may be made therein without departing from the spirit and scope of the invention. The invention shall be viewed as limited only by reference to the following claims.

What is claimed is:

1. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein the upper body support comprises an elevation bar attached to the track, a cross bar attached to the elevation bar, and at least one arm pad attached to the cross bar; and wherein the elevation bar is attached to the track such that the sled can travel past the elevation bar on the track.

2. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein the upper body support comprises an elevation bar attached to the track, a cross bar attached to the elevation bar, and at least one arm pad attached to the cross bar; and wherein the cross bar is pivotally attached to the elevation bar and suspended approximately 12 to approximately 48 inches above the track.

3. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein the upper body support comprises an elevation bar attached to the track, a cross bar attached to the elevation bar, and at least one arm pad attached to the cross bar; and wherein the upper body support comprises at least one chest pad.

4. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein the upper body support comprises an elevation bar attached to the track, a cross bar attached to the elevation bar, and at least one arm pad attached to the cross bar; and wherein the upper body support comprises at least one head support.

5. The abdominal exercise machine of claim 2 wherein the sled contains an instep pad.

6. The abdominal exercise machine of claim 2 wherein the sled contains a knee pad.

7. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein the sled contains a knee pad; and wherein the knee pad can rotate approximately 2 to approximately 45 degrees to the right or left of a plane vertical to the center of the sled.

8. The abdominal exercise machine of claim 2 wherein weights can be added to the sled.

9. An abdominal exercise machine to work the abdominal and oblique muscle groups and can isolate the upper and lower abdominal muscles in a biometrically neutral position, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track wherein an elastic cord is attached to the sled and to the rear support.

10. The abdominal exercise machine of claim 9 wherein the upper body support comprises an elevation bar attached to the track, a cross bar attached to the elevation bar, and at least one arm pad attached to the cross bar.

11. The abdominal exercise machine of claim 2 wherein the upper body support is forced to pivot towards the track when the sled is accelerated towards the upper body support.

12. A method to exercise the abdominal and oblique muscle groups in a biometrically neutral position, the method comprising the steps of positioning the body on an abdominal exercise machine, the abdominal exercise machine comprising:

a rear support;

at least one track having a front portion and a back portion wherein the back portion is attached to the rear support;

a front support wherein the front support is attached to the front portion of the at least one track and elevates the front portion of the at least one track approximately 6 inches off the ground;

an upper body support attached to the front end of the track; and a sled that can slide on the track from the back portion to the front portion of the track; and using the abdominal muscles to accelerate the sled from the rear portion of the track to the front portion of the track wherein the knees are on the sled and the upper body is on the upper body support wherein the upper body support comprises an elevation bar attached to the track, a cross bar attached to the elevation bar, and at least one arm pad attached to the cross bar.

13. The method of claim 12 wherein the upper body support further comprises at least one chest pad.

14. The method of claim 12 wherein the cross bar is pivotally attached to the elevation bar and suspended approximately 12 to approximately 48 inches above the track.

15. The method of claim 14 wherein the upper body support is forced to pivot towards the track when the sled is accelerated towards the upper body support.

16. The method of claim 15 wherein a bell crank is used to force the upper body support to pivot towards the track when the sled is accelerated towards the upper body support.

17. The method of claim 15 wherein a pulley system is used to force the upper body support to pivot towards the track when the sled is accelerated towards the upper body support.

* * * * *